US007664429B2

(12) United States Patent
Murai et al.

(10) Patent No.: US 7,664,429 B2
(45) Date of Patent: Feb. 16, 2010

(54) TRANSFER MECHANISM AND IMAGE FORMING APPARATUS USING THE SAME

(75) Inventors: Hiroyuki Murai, Yamatokoriyama (JP); Toshiki Takiguchi, Yamatokoriyama (JP); Junya Masuda, Nara (JP); Toshihiko Seike, Nara (JP); Kazuhiro Matsuyama, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 435 days.

(21) Appl. No.: 11/768,021

(22) Filed: Jun. 25, 2007

(65) Prior Publication Data

US 2008/0124139 A1 May 29, 2008

(30) Foreign Application Priority Data

Jun. 26, 2006 (JP) ..... 2006-174877
Jun. 29, 2006 (JP) ..... 2006-179536

(51) Int. Cl.
*G03G 15/08* (2006.01)

(52) U.S. Cl. ..... 399/121

(58) Field of Classification Search ..... 399/107, 399/110, 121, 159, 162, 165, 302, 303, 308, 399/313

See application file for complete search history.

(56) References Cited

U.S. PATENT DOCUMENTS 6,766,129 B2 * 7/2004 Loebel et al. ..... 399/165
6,968,143 B2 * 11/2005 Blair et al. ..... 399/124

FOREIGN PATENT DOCUMENTS

JP 8-278707 A 10/1996
JP 9-274355 A 10/1997
JP 10-39651 A 2/1998
JP 2000-235309 A 8/2000
JP 2001-16602 A 6/2001
JP 2005-91613 A 4/2005

* cited by examiner

*Primary Examiner*—Hoan H Tran
(74) *Attorney, Agent, or Firm*—Birch, Stewart, Kolasch & Birch LLP

(57) ABSTRACT

A transfer mechanism includes: a transfer unit having a transfer belt; and a belt contact and separation assembly for bringing the transfer belt into, and separating it away from, an electrostatic latent image support by shifting the position of the transfer unit. The belt contact and separation assembly includes: a multiple number of transfer unit shifters that abut the transfer unit and shift the position of the transfer unit; a multiple number of linkage members that link with the plural transfer unit shifters, correspondingly; an elastic member for coupling the plural linkage members; and a driver for actuating the transfer unit shifters through the linkage members.

20 Claims, 9 Drawing Sheets

TRANSFER MECHANISM AND IMAGE FORMING APPARATUS USING THE SAME

This Nonprovisional application claims priority under 35 U.S.C. §119(a) on Patent Application No. 2006-174877 filed in Japan on 26 Jun. 2006 and Patent Application No. 2006-179536 filed in Japan on 29 Jun. 2006, the entire contents of which are hereby incorporated by reference.

BACKGROUND OF THE INVENTION (1) Field of the Invention

The present invention relates to a transfer mechanism and an image forming apparatus using the same, and in particular, relates to a transfer mechanism which is used in an image forming apparatus that is applied to a copier, multi-functional machine, printer, facsimile machine and the like that uses electrophotography and outputs images in accordance with print requests, as well as to an image forming apparatus using this transfer mechanism.

(2) Description of the Prior Art

A typical transfer mechanism for use in an image forming apparatus has a function of transferring image information (toner image or developer image) that was developed on an electrostatic latent image support (photoreceptor drum), to a recording medium (paper) being conveyed, by bringing the paper into contact with the photoreceptor drum while applying a transfer electric field to the paper from the rear side of the paper.

In recent years, with the trend of image forming apparatus towards becoming compact and high-speed in configurations, use of a belt transfer system using an endless belt as a transfer mechanism has been increasingly developed.

The belt transfer system is constructed such that an endless belt is used to convey the paper while the paper or the endless belt is brought into contact with a photoreceptor drum to thereby transfer the toner image visualized on photoreceptor drum to the paper or endless belt. In most cases, the belt transfer system is provided in the form that includes a belt contact and separation mechanism for moving the endless belt into and out of contact with the photoreceptor drum.

Actually, during the transfer stage, the paper or the endless belt is brought into contact with the photoreceptor drum, but during the non-transfer stage, the belt needs to be kept out of contact with the photoreceptor drum so as to prevent the endless belt from being worn out or deteriorated.

To deal with this, there has been a known technique, as a conventional belt contact and separation mechanism, which uses a cam mechanism to move the transfer unit relative to the photoreceptor drum (see patent document 1: Japanese Patent Application Laid-open H08-137166). Illustratively, an endless belt (transfer belt), a multiple number of rollers that support the belt and a transfer roller are assembled as a single transfer unit, and this transfer unit as a whole is moved into and out of contact with the photoreceptor drum by a cam system.

However, since the above cam mechanism is configured to be driven by actuating cams by manually rotating a handle, it needs a complicated drive coupling technique. Further, since the transfer unit is manually moved up and down, there is the problem of poor response when it is applied to a high-speed printing process.

To avoid this problem there is a method of moving the transfer unit as a whole by using, as a drive source, a solenoid which presents excellent operational response. In this case, a multiple number of cams are arranged in series along the width direction of the transfer belt, and the multiple cams coupled in series are operated by switching on and off a single solenoid.

However, in the above method using a solenoid, there occur some cases in which contact and separation between the transfer belt and the photoreceptor drum cannot be achieved smoothly due to an operational delay of the cam or cams located on the far side from the solenoid depending on the assembly and/or machining accuracy. For example, there occurs a case in which the transfer belt comes into contact with the photoreceptor drum on the side near to the solenoid while it remains away from the photoreceptor drum on the side far from the solenoid.

SUMMARY OF THE INVENTION

The present invention has been devised in view of the above conventional problems, it is therefore an object of the present invention to provide a transfer mechanism of a belt system which can assure correct operation of contact and separation between a photoreceptor drum and a transfer belt in the transfer mechanism.

The transfer mechanism according to the present invention for solving the above problems are configured as follows.

A transfer mechanism according to the first aspect of the present invention includes: a transfer unit having a transfer belt; and, a belt contact and separation assembly for bringing the transfer belt into, and separating it away from, an electrostatic latent image support by shifting the position of the transfer unit, and is characterized in that the belt contact and separation assembly includes: a plurality of transfer unit shifters that abut the transfer unit and shift the position of the transfer unit; a plurality of linkage members that link with the plural transfer unit shifters, correspondingly; an elastic member for coupling the plural linkage members; and a driver for actuating the transfer unit shifters through the linkage members.

The transfer belt of the present invention includes one that transfers the developer image visualized on the electrostatic latent image support to a recording medium that is being conveyed by the transfer belt and one that transfers the developer image visualized on the electrostatic latent image support, directly the transfer belt surface.

A transfer mechanism according to the second aspect of the present invention is characterized in that, in addition to the configuration described in the first aspect, the driver is a solenoid.

A transfer mechanism according to the third aspect of the present invention is characterized in that, in addition to the configuration described in the first or second aspect, the transfer unit shifter makes rotational movement as the driver operates.

A transfer mechanism according to the fourth aspect of the present invention is characterized in that, in addition to the configuration described in any one of the first through third aspects, the driving force of the driver is directly transmitted to a first one of the plural transfer unit shifters, and the driving force is indirectly transmitted to the transfer unit shifters other than the first transfer unit shifter, by way of the elastic member.

A transfer mechanism according to the fifth aspect of the present invention is characterized in that, in addition to the configuration described in any one of the first through fourth aspects, the transfer unit shifters are actuated by the driving force of the driver to shift the transfer unit up and down, so as to bring the transfer unit into contact with and separate it away from, the electrostatic latent image support.

A transfer mechanism according to the sixth aspect of the present invention is characterized in that, in addition to the configuration described in any one of the first through fifth aspects, the transfer unit shifters are arranged at both side ends of the width of the transfer belt of the transfer unit.

A transfer mechanism according to the seventh aspect of the present invention is characterized in that, in addition to the configuration described in any one of the first through sixth aspects, when the transfer belt is set at the home position for separation in which the transfer belt is kept away from the electrostatic latent image support, the first transfer unit shifter arranged close to the driver is positioned a first distance away from the electrostatic latent image support; the second transfer unit shifter arranged farther from the driver than the first transfer unit shifter is positioned a second distance away from the electrostatic latent image support; and, the second distance is shorter than the first distance.

A transfer mechanism according to the eighth aspect of the present invention is characterized in that, in addition to the configuration described in the seventh aspect, at the home position for separation, the transfer belt is separated from the electrostatic latent image support, keeping a uniform gap distance across the full length of the transfer belt.

A transfer mechanism according to the ninth aspect of the present invention is characterized in that, in addition to the configuration described in the eighth aspect, it further comprises a holding member for holding the transfer unit in order to assure the uniform gap distance.

A transfer mechanism according to the tenth aspect of the present invention is characterized in that, in addition to the configuration described in the eighth aspect, the uniform gap distance is at least a distance that prohibits the residual toner on the electrostatic latent image support from transferring to the transfer belt under the influence of the electric field applied to the transfer belt.

An image forming apparatus according to the eleventh aspect of the present invention is an image forming apparatus for producing image output in accordance with a print request, includes: an image forming portion having an electrostatic latent image support on which a developer image is formed with a developer; a transfer mechanism for transferring the developer image to the transfer belt side; and, a fixing unit for fixing the developer image transferred by the transfer mechanism, onto the recording medium, and is characterized in that the transfer mechanism is one of those described in the above first to tenth aspects.

In accordance with the first aspect of the present invention, it is possible to reliably achieve the operation of moving the transfer belt into and out of contact with the electrostatic latent image support.

According to the second aspect of the invention, in addition to the effect obtained by the first aspect, it is possible to simplify the driving mechanism for the contact and separation movement. It is also possible to enhance the response of the contact and separation movement of the transfer unit, even in a high-speed printing process.

According to the third aspect of the invention, in addition to the effect obtained by the first or second aspect, it is possible to realize an apparatus configuration that is simple and space-saving.

According to the fourth aspect of the invention, in addition to the effect obtained by the first through third aspects, use of the elastic member makes it possible to tolerate a greater degree of parts errors and assembly errors, it is hence possible to achieve accurate drive transmission without relying on high-precision machining and/or high-quality assembly technology.

According to the fifth aspect of the invention, in addition to the effect obtained by the first through fourth aspects, this configuration makes it possible to shift the position of the transfer unit in a stable manner and makes it possible to easily move the recording medium or transfer belt into and out of contact with the electrostatic latent image support whose axis is laid out approximately horizontal.

According to the sixth aspect of the invention, in addition to the effect obtained by the first through fifth aspects, it possible to shift the position of the transfer unit in a stable manner with a structure that is space-saving and configured with a lower number of components.

According to the seventh aspect of the invention, in addition to the effect obtained by the first through sixth aspects, it is possible to smoothly actuate the second transfer unit shifter that is poor in response compared to the first transfer unit shifter, hence move the transfer belt, reliably and uniformly, into and out of contact with the electrostatic latent image support. It is also possible to bring the transfer belt into contact with the electrostatic latent image support, at the same timing across the width.

According to the eighth aspect of the invention, in addition to the effect obtained by the first through seventh aspects, it is possible to achieve contact and separation movement of the transfer belt in a reliable manner and hence effect a reliable transfer process.

According to the ninth aspect of the invention, in addition to the effect obtained by the first through eighth aspects, it is possible to reliably achieve the operation of contact and separation between the electrostatic latent image support and the transfer belt. Further, this configuration makes it possible to prevent the transfer belt from meandering by eliminating the twist of the transfer unit when the transfer unit is kept away from the electrostatic latent image support (at the home position for separation)

According to the tenth aspect of the invention, in addition to the effect obtained by the first through ninth aspects, when the transfer unit is positioned at the home position for separation, no influence of the electric field applied to the transfer belt will affect the electrostatic latent image support.

According to the eleventh aspect of the invention, in addition to the effect obtained by the first through tenth aspects, it is possible to achieve stable image forming by performing a reliable operation for contact and separation between the electrostatic latent image support and the transfer belt.

DESCRIPTION OF THE PREFERRED EMBODIMENTS

The First Embodiment

Referring next to FIGS. 1 to 6, the embodiment of the present invention will be described in detail.

Figure 1:
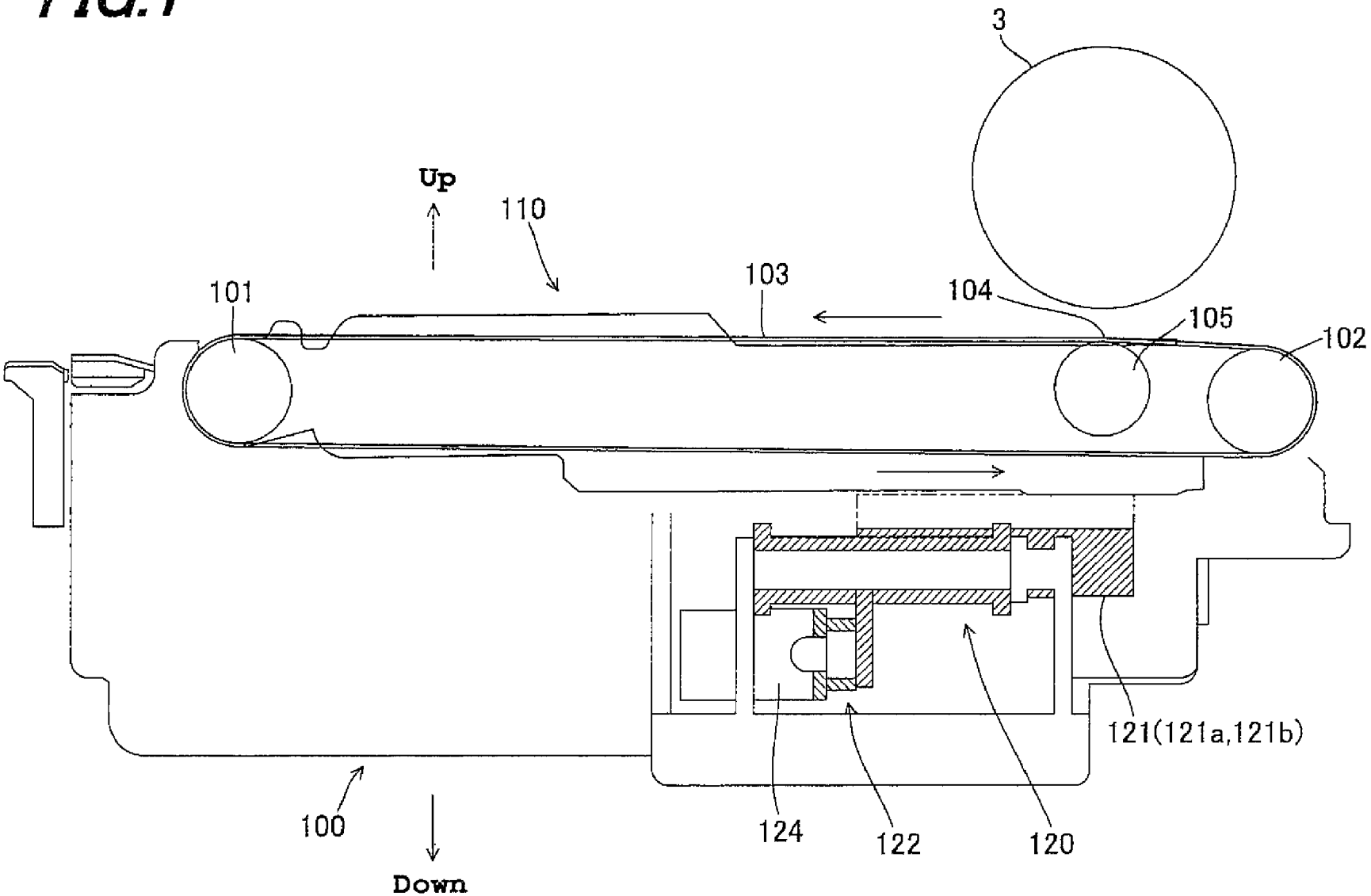
FIG. 1 is an illustrative side view showing a transfer mechanism configuration according to the first embodiment of the present invention.
Figure 2:
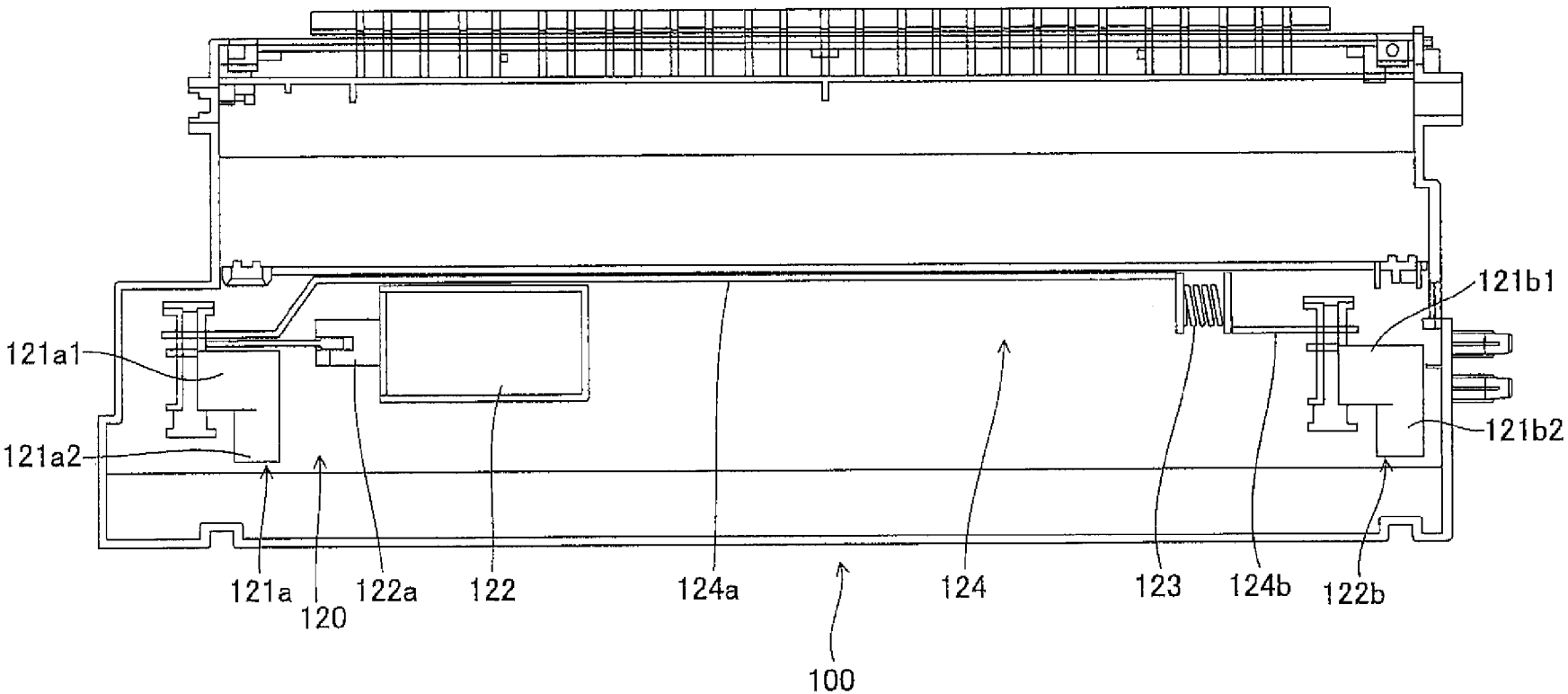
FIG. 2 is an illustrative plan view showing the same transfer mechanism configuration.

A transfer mechanism 100 according to the present embodiment includes a transfer unit 110 and a belt contact and separation assembly 120 (FIGS. 1 and 2). In FIG. 1, designated at 3 is a photoreceptor drum (electrostatic latent image support).

(Transfer Unit 110)

Transfer unit 110 has an endless transfer belt 103 for conveying paper (recording media) (FIG. 1). Transfer unit 110 transfers the toner image (developer image) developed on the photoreceptor drum 3 surface to the paper that is being conveyed by the transfer belt 103.

Here, transfer belt 103 may be configured so as not to convey the paper. That is, transfer belt 103 may be configured so that the toner image developed on the photoreceptor drum 3 surface is directly transferred to the transfer belt 103 surface.

Transfer unit 110 is arranged under photoreceptor drum 3.

Transfer unit 110 is laid out so that transfer belt 103 is kept away with even or uneven distance with respect to the full length of photoreceptor drum 3 when transfer belt 103 is positioned out of contact with photoreceptor drum 3 (home position for separation).

When transfer unit 110 is positioned with its transfer belt 103 in contact with photoreceptor drum 3, transfer belt 103 is arranged so as to create a uniform transfer nip width with photoreceptor drum 3 (home position for contact).

In FIG. 1, 101 designates a drive roller, 102 a driven roller and 105 an elastic conductive roller.

(Belt Contact and Separation Assembly 120)

Belt contact and separation assembly 120 causes transfer belt 103 to move into and out of contact with photoreceptor drum 3 by shifting the position of the transfer unit 110.

Belt contact and separation assembly 120 includes a plurality of lift arms (transfer unit shifting members) 121*a* and 121*b*, a linkage subassembly 124 composed of a plurality of linkage members 124*a*, 124*b* and a coil spring (elastic member) 123, and a single solenoid (driver) 122 (see FIG. 3).

The lift arms are cam members that change the direction of the drive from solenoid 122. Lift arms 121*a* and 121*b* in the present embodiment deflect the driving force of solenoid 122, directed horizontally, by approximately 90 degrees (including 90 degrees) and transmit the force to the vertical direction. However, the angle of deflection of the direction of the driving force is not limited to approximately 90 degrees, but it can be determined as appropriate depending on the position of attachment of solenoid 122.

Lift arms 121*a* and 121*b* abut the undersurface of transfer unit 110 and move transfer unit 110 up and down in linkage with the horizontal linear movement of solenoid 122. The number of the lift arms may be any number as long as it is two or more. The detailed configuration of lift arms 121*a* and 121*b* will be described later.

Linkage members 124*a* and 124*b* are connected at their one end to aforementioned lift arms 21*a* and 121*b*, respectively while the other ends are connected to a coil spring 123. That is, linkage members 124*a* and 124*b* are coupled by coil spring 123. The number of linkage members may be any number as long as it is two or more.

Any elastic member can be used in place of spring 123. Examples of the elastic member includes a coil spring, leaf spring, volute spring, disc spring, power spring, rubber materials and the like.

Solenoid 122 is a driving source for actuating lift arms 121 via linkage subassembly 124. Solenoid 122 has an actuating part 122*a* that moves forwards and backwards as the power is switched on and off.

(Lift Arms 121)

Figure 3A:
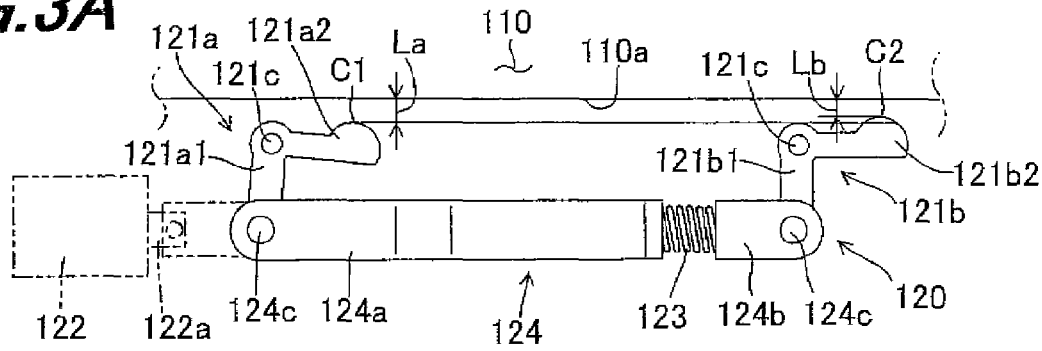
FIG. 3A is an illustrative side view showing a state in which a belt contact and separation assembly is kept away from a transfer unit (home position for separation)
Figure 3B:
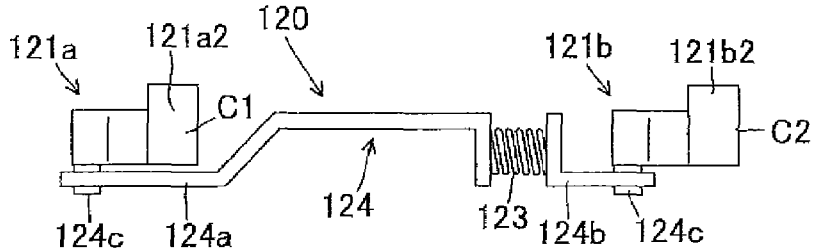
FIG. 3B is a illustrative plan view showing the belt contact and separation assembly shown in FIG. 3A.
Figure 3C:
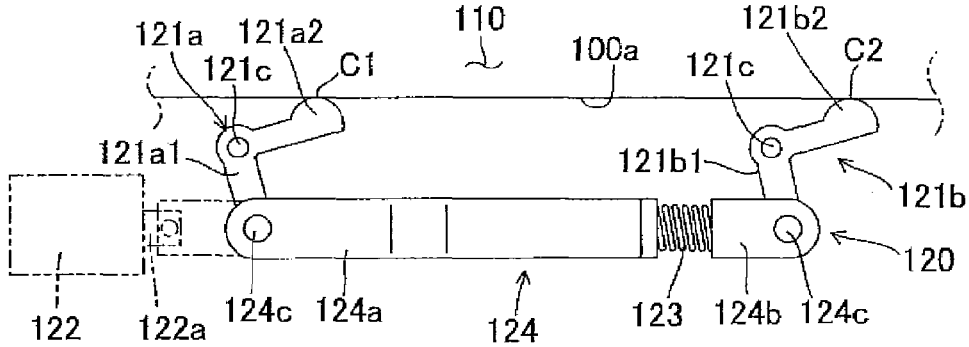
FIG. 3C is an illustrative side view showing a state in which the belt contact and separation assembly pushes up the transfer unit.
Figure 3D:
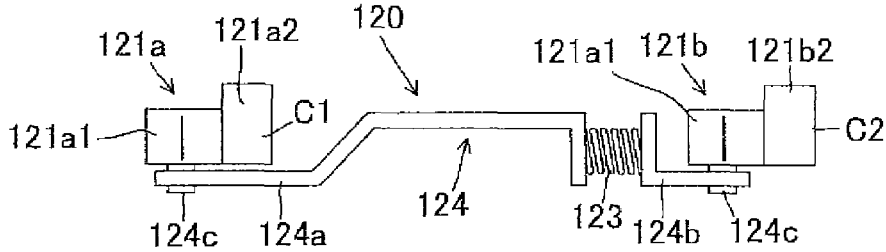
FIG. 3D is an illustrative plan view showing the belt contact and separation assembly shown in FIG. 3C.

As shown in FIGS. 3A and 3C, lift arms 121 are arranged at plural positions along the width direction of transfer belt 103 (the direction perpendicular to the transfer belt 103's direction of movement) at approximately the same height (approximately the same level). In the present embodiment, two lift arms 121*a* and 121*b* are laid out at both side ends of transfer unit 110 with respect to the aforementioned width direction.

Hereinbelow, lift arm 121*a* is called first lift arm 121*a* and lift arm 121*b* is called second lift arm 121*b*.

First lift arm 121*a* and second lift arm 121*b* have the almost the same configurations, so that first lift arm 121*a* will be described as an example.

First lift arm 121*a* is formed in an approximately L-shape. Specifically, first lift arm 121*a* is composed of a connecting piece 121*a*1 and a lifting piece 121*a*2 being joined to one another at a bent portion. This bent portion is angled at approximately 90 degrees. Formed in this bent portion is an attachment hole which is rotatably fitted on a support axle 121*c*.

Support axle 121*c* serves as a reference point based on which contact and separation movement between transfer unit 110 and belt contact and separation assembly 120 is made. Accordingly, support axle 121*c* is fixed at its one end to a part that will not make any contact and separation movement. For example, support axle 121*c* is fixed to the frame of transfer mechanism 100.

First lift arm 121*a* is attached to support axle 121*c* by positioning connecting piece 121*a*1 downward and placing lifting piece 121*a*2 approximately horizontal.

The distal end of connecting piece 121*a*1 is rotationally coupled to linkage subassembly 124 by means of a support axle 124*c*. Support axle 124*c* may be formed either on connecting piece 121*a*1 or linkage subassembly 124, or may be formed separately from connecting piece 121*a*1 and linkage subassembly 124.

The distal end of lifting piece 121*a*2 has a first abutment C1 which abuts the bottom, designated at 110*a*, of transfer unit 110. The distal end of lifting piece 121*b*2 of second lift arm 121*b* is called a second abutment C2.

First abutment C1 is formed in a circular arc shape when viewed sectionally. This assures smooth movement of first abutment C1 when it abuts bottom 110*a* and slides therealong.

(Linkage Subassembly 124)

Linkage subassembly 124 includes first arm 124*a* that is coupled with first lift arm 121*a* and second arm part 124*b* that is coupled with second lift arm 121*b*. Interposition of coil spring 123 between first arm part 124*a* and second arm part 124*b* enables linkage subassembly 124 to expand and contract in its longitudinal direction (the direction of coupling).

First arm part 124*a* is coupled at one end opposite to the coil spring, to actuating part 122*a* of solenoid 122. With this arrangement, the drive of solenoid 122 is directly transferred to first arm part 124*a*. Here, actuating part 122*a* may be connected to support axle 124*c* or connecting piece 121*a*1 of first lift arm 121*a*.

The driving force of solenoid 122 is transmitted to second arm part 124*b* by way of coil spring 123.

Illustratively, as solenoid 122 is driven, the drive is directly transmitted to first arm 121*a* that is coupled with first arm part 124*a* while the drive is indirectly transmitted to second lift arm 121*b* that is coupled with second arm part 124*b*, by way of coil spring 123.

(Operation Timing Adjustment)

In the present embodiment, in order to adjust the operation timings of first lift arm 121*a* and second lift arm 121*b*, the distance between second abutment C2 that is located farther from solenoid 122 and photoreceptor drum 3 is designed to be shorter than the distance between first abutment C1 that is located closer to solenoid 122 and photoreceptor drum 3 when they are set at their retracted home position. In FIG. 3A, the distance La between first abutment C1 and bottom 110*a* of transfer unit 110 and the distance Lb between second abutment C2 and the aforementioned bottom 110*a* are designated so that a relationship La>Lb holds.

In other words, the position of second abutment C2 is set to be higher than that of first abutment C1 by the difference (Lb−La) by attaching first lift arm 121*a* and second lift arm 121*b* with the latter advanced from the former in phase.

The distance Lb between second abutment C2 and bottom 110*a* can be adjusted by controlling, for example, the elastic force of coil spring 123, the length of second arm part 124*b* and/or the shape of second lift arm 121*b*. In the present embodiment, since the first lift arm 121*a* and second lift arm 121*b* have the same configuration, the distance Lb can be adjusted by for example, the elastic force of coil spring 123 and/or the length of second arm part 124*b*.

Here, when the distance Lb is adjusted by the shape of second lift arm 121*b*, this can be done, for example by making the length of connecting piece 121*b*1 shorter than that of connecting piece 121*a*1, by making the bent portion of second lift arm 121*b* greater than that of first lift arm 121*a*, and/or by other methods.

(Operating Principle)

Next, the operation of transfer mechanism 100 according to the present embodiment will be described with reference to the drawings.

Normally, when transfer mechanism 100 is out of operation, photoreceptor drum 3 and transfer belt 103 are kept away from each other (home position for separation). The operation of transfer mechanism 100 having a configuration in which first abutment C1 and second abutment C2 are kept away from bottom 110*a* of transfer unit 110 when the are set at the home position for separation as shown in FIG. 3A will be described.

When photoreceptor drum 3 and transfer belt 103 are caused to abut each other by actuating transfer mechanism 100, solenoid 122 is activated so that its actuating part 122*a* moves forward in the approximately horizontal direction in the drawing, as shown in FIG. 3C. Actuating part 122*a* moves first arm part 124*a* that is connected to itself, in the approximately horizontal direction (rightwards in the drawing).

As first arm part 124*a* moves rightwards, connecting piece 121*a*1 of first lift arm 121*a* that is rotatably coupled with the first arm part 124*a* sways counterclockwise. With this swaying, first arm part 124*a* rotates counterclockwise and lifting piece 121*a*2 sways upwards.

As first arm part 124*a* moves, second arm part 124*b* is also caused to move by way of coil spring 123 in the approximately horizontal direction in the drawing. With this movement, connecting piece 121*b*1 of second lift arm 121*b* that is rotatably coupled with the second arm part 124*b* sways counterclockwise, whereby second arm part 124*b* rotates counterclockwise and lifting piece 121*b*2 sways upwards.

Both lifting pieces 121*a*2 and 121*b*2 of first and second lift arms 121*a* and 121*b*, swaying upwards, abut bottom 110*a* of transfer unit 110 and rotate further to raise transfer unit 110 by a predetermined distance.

Figure 6:
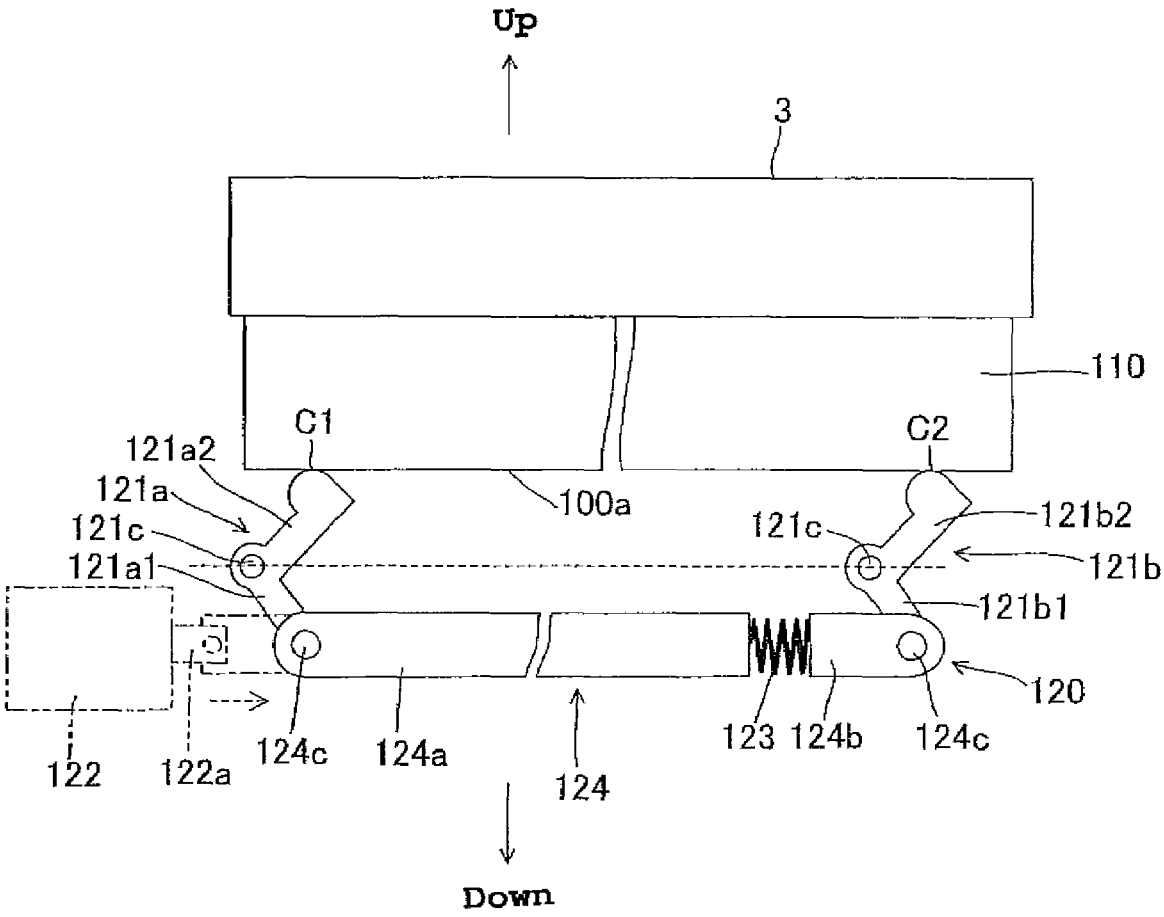
FIG. 6 is an illustrative view showing a state in which the transfer unit is brought in contact with a photoreceptor drum (home position for contact)

Transfer unit 110 moves up to the position (home position for contact) at which transfer belt 103 comes into pressure contact with photoreceptor drum 3 across its full length (FIG. 6). During this movement, the difference in phase between first lift arm 121*a* and second lift arm 121*b* are cancelled out by assembly accuracy and machining accuracy.

At the contact home position, first lift arm 121*a* and second lift arm 121*b* take rotated positions of the same inclination angle. In this situation, of the phase difference between first and second lift arms 121*a* and 121*b*, the phase difference that cannot be canceled out by assembly accuracy and machining accuracy is absorbed by elastic deformation (expansion and contraction, flexion) of coil spring 123, so that both arms push transfer unit 110 against photoreceptor drum 3 with almost the same forces. Accordingly, transfer belt 103 creates and maintains a uniform transfer nip width with photoreceptor drum 3.

That is, even when a plurality of cams arranged in series are actuated by driving a single solenoid 122, it is possible to obtain a uniform nip width of a predetermined amount by bringing transfer belt 103 into pressure contact with photoreceptor drum 3 across its full length.

When transfer belt 103 is separated from photoreceptor drum 3, solenoid 122 is operated in reverse to the action described above to pull back actuating part 122*a* (retraction).

As linkage subassembly 124 is moved leftwards in the drawing by solenoid 122, connecting piece 121*a*1 of first lift arm 121*a* that is rotatably coupled with the first arm part 124*a* sways clockwise. With this swaying, first arm part 124*a* rotates clockwise and lifting piece 121*a*2 sways downwards.

As first arm part 124*a* moves, second arm part 124*b* is also caused to move by way of coil spring 123 in the approximately horizontal direction in the drawing. With this movement, connecting piece 121*b*1 of second lift arm 121*b* that is rotatably coupled with the second arm part 124*b* sways clockwise, whereby second arm part 124*b* rotates clockwise and lifting piece 121*b*2 sways downwards.

Lifting pieces 121*a*2 and 121*b*2 move down transfer unit 110 and further rotate and move away from transfer unit 110 to their predetermined positions. That is, transfer unit 110 moves down to the position at which transfer belt 103 is away from photoreceptor drum 3, and first and second lift arms 121*a* and 121*b* are positioned away from transfer unit 110.

EXAMPLE

There are at least two ways for regulating the aforementioned difference (Lb−La).

The first regulating way is a method in which the distances from bottom 110*a* of transfer unit 110 to first and second abutments C1 and C2 are defined as distances La and Lb, as shown in FIG. 3A.

Figure 5:
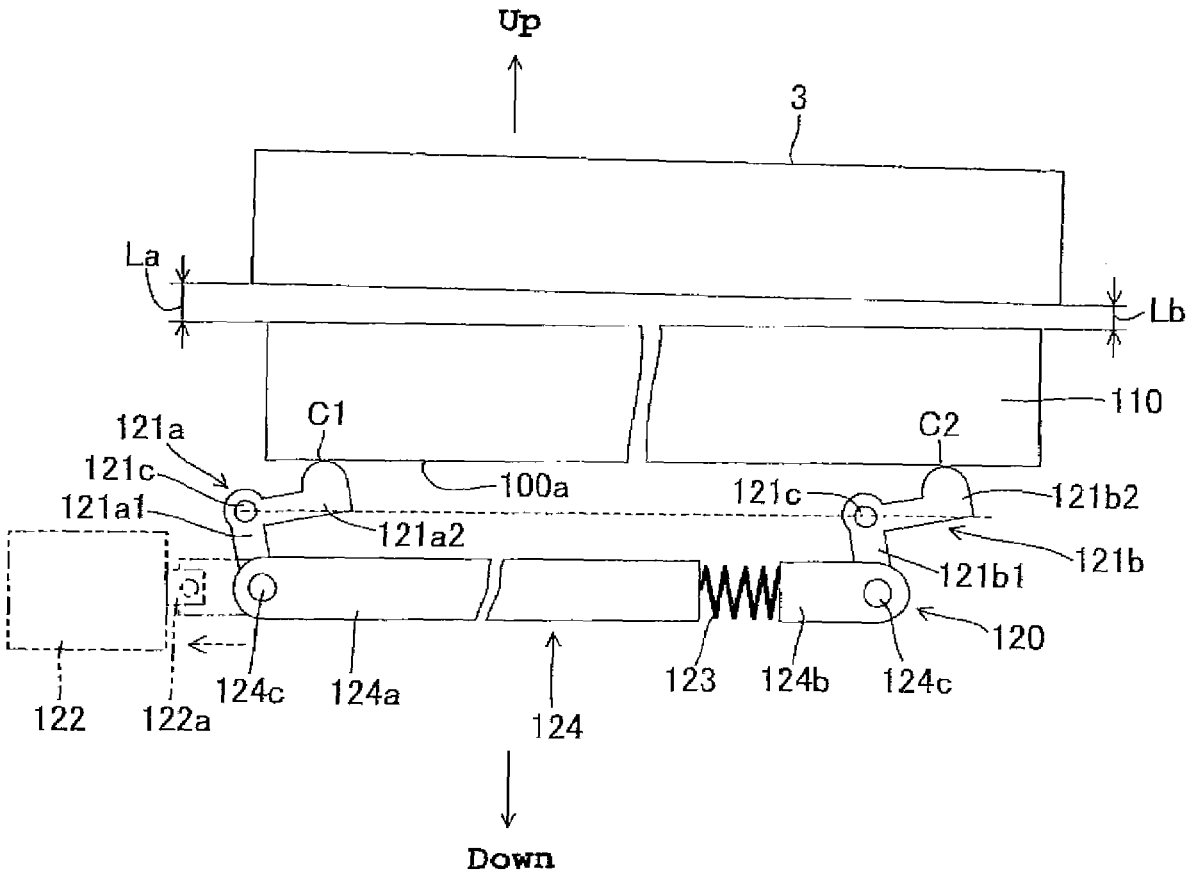
FIG. 5 is an illustrative view showing a state in which the transfer unit is arranged away from the belt contact and separation assembly (home position for separation)

The second regulating way is a method in which the distances between photoreceptor drum 3 and transfer belt 103 at both ends are defined as distances La and Lb, as shown in FIG. 5.

(The First Regulating Method)

Figure 4:
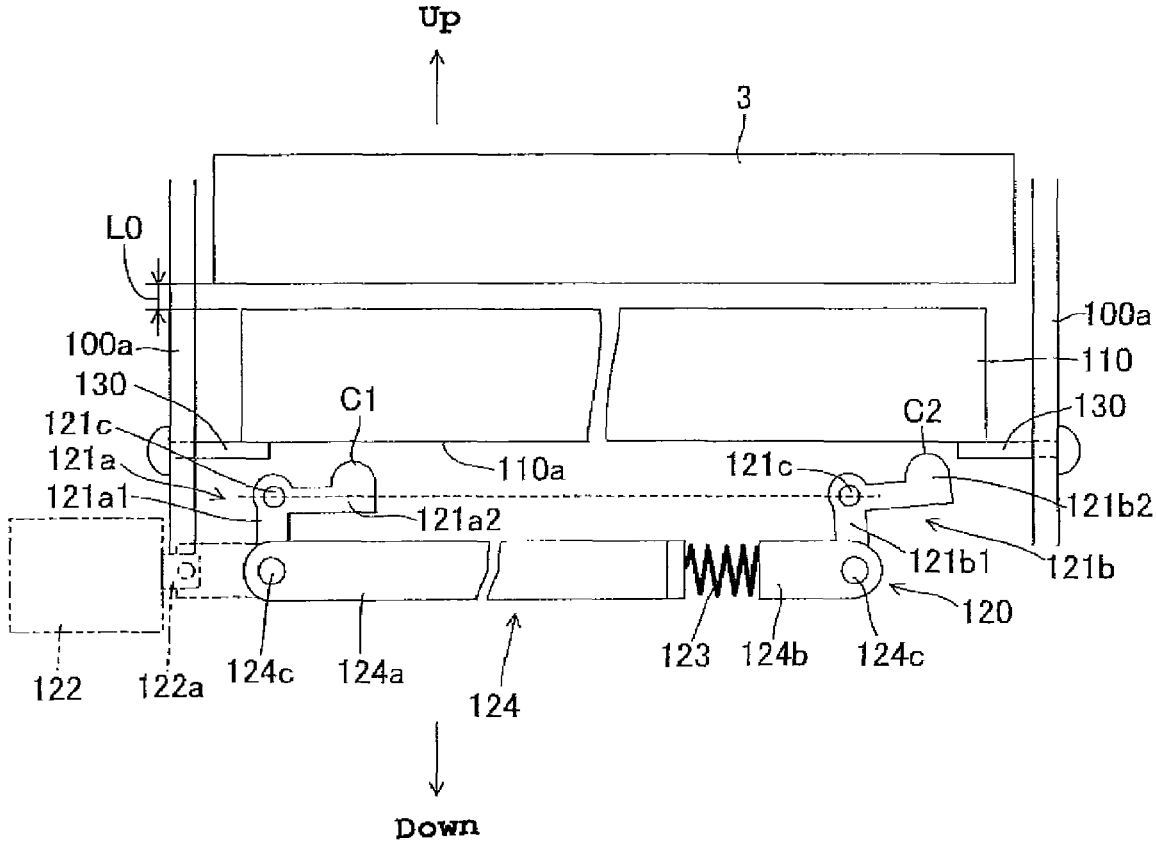
FIG. 4 is an illustrative view showing a state in which the transfer unit is arranged away from the belt contact and separation assembly (home position for separation)

In order to realize the first regulating method shown in FIG. 3A, two holding members 130 are provided in the frame, designated at 100*a*, of transfer mechanism 100, as shown in FIG. 4. That is, these holding members 130 support the undersurface of transfer unit 110 so as to keep distances La and Lb from bottom 110*a* of transfer unit 110 to first and second abutments C1 and C2 when transfer unit 110 is positioned at the home position for separation (the first posture).

In the first posture, transfer belt 103 creates a gap with a uniform gap distance L0 from photoreceptor drum 3 across the belt width, as shown in FIG. 4.

In the first posture, the differential distance (Lb−La) is formed while no load is being acted on second abutment C2. Accordingly, it is possible to adjust the position of second abutment C2 so as to create the necessary differential distance by controlling the elastic force of coil spring 123, the length of second arm part 124*b* and/or the shape of second lift arm 121*b*, for instance.

A pair of holding members 130 shown in FIG. 4 are projected approximately perpendicularly from the surfaces of frame 100*a* and arranged at the same position with respect to the transfer belt 103's direction of conveyance.

Holding members 130 should not be limited as to their shape, number and position as long as they can support transfer unit 110. For example, holding member 130 may be a pin element, bar element, projected structure, step or the like. The number of holding members 130 is not particularly limited, one piece, a pair or a plurality of holding members may be used.

According to the first regulating method, it is possible to make the movement of transfer unit 110 by approximately vertical translation. As a result it is possible to achieve the movement for contact and separation between photoreceptor drum 3 and transfer belt 103 in a reliable manner.

Further, provision of holding members 130 enables transfer unit 110 to keep the same posture when it is at the home position for separation and when it is at the home position for contact. As a result, the movement from the home position for separation to the home position for contact can be done by a mere translation of transfer belt 103, so that it is possible to prevent meander of transfer belt 103, which would occur if the posture of transfer unit 110 was changed.

(The Second Regulating Method)

The second regulating method shown in FIG. 5 can he realized by constantly supporting bottom 110*a* of transfer unit 110 with first and second lift arms 121*a* and 121*b* (the second posture). Accordingly, transfer unit 110 moves up and down (comes into and out of contact) in conformity with the rotations of first and second lift arms 121*a* and 121*b*.

Since the second regulating method does not need any supporting member 130 the structure can be made simple.

In the second posture, the differential distance (Lb−La) is created when a load (transfer unit 110) is acting on second abutment C2. Accordingly, it is possible to adjust the position of second abutment C2 so as to create this differential distance, by controlling the elastic force of coil spring 123, the length of second arm part 124*b* and/or the shape of second lift arm 121*b*, for example.

(Effect)

According to the present embodiment, the moving range of second lift arm 121*b* that is located farther from solenoid 122 is made narrower than that of first lift arm 121*a* that is located closer to solenoid 122, with respect to the direction (vertical direction) in which the transfer unit 110 moves when coming into and out of contact. Accordingly, it is possible to reliably bring transfer belt 103 into and out of contact with photoreceptor drum 3 across its full length even when the configuration involves machining errors and assembly errors. Further, if there is a delay in action of second lift arm 121*b* that is located far from the actuating point (solenoid 122), the arrival of second lift arm 121*b* at bottom 110*a* of transfer unit 110 can be synchronized with that of the first lift arm by delaying the arrival of first lift arm 121*a* at bottom 110*a* of transfer unit 110 by virtue of the difference in range of movement.

Further, in the present embodiment, as a configuration of linkage subassembly 124, first arm part 124*a* that is coupled to first lift arm 121*a* and second arm part 124*b* that is coupled to second lift arm 121*b* are connected by coil spring 123. Accordingly, with respect to the difference in range of movement between first lift arm 121*a* and second lift arm 121*b*, the differential range of movement that cannot be canceled by assembly accuracy and machining accuracy can be absorbed by elastic deformation (expansion and contraction, flexion) of coil spring 123. As a result, first lift arm 21*a* and second lift arm 121*b* push transfer unit 110 with approximately equivalent forces so as to create and maintain a uniform transfer nip width between transfer belt 103 and photoreceptor drum 3.

Further, machining errors and assembly errors can be absorbed by the repulsive force of elastic member 123. Accordingly, the above operation of first and second lift arms 121*a* and 121*b* can be made reliable, so that it is possible to reliably achieve the operation for contact and separation between the transfer belt and photoreceptor drum 3.

When the first posture is adopted to create the difference in the moving range, the vertical movement of transfer unit 110 across the paper width can be achieved essentially by a translation. Accordingly, it is possible to reliably achieve the operation for contact and separation between transfer belt 103 and photoreceptor drum 3. Further, since transfer belt 103 can be supported approximately horizontal when transfer unit 110 is retracted, it is possible to avoid the transfer unit being twisted, hence prevent transfer belt 103 from meandering. As a result, stable paper conveyance can be assured, and this realizes highly qualified image output.

On the other hand, use of the second regulating method (second posture) makes holding members 130 unnecessary, hence the configuration of transfer mechanism 100 can be simplified.

It should be noted that the elastic member of the present invention may use other spring elements and rubber materials, instead of the aforementioned coil spring 123, as long as it can present an elastic function.

Furthers the embodiment is constructed so that abutment between photoreceptor drum 3 and transfer belt 103 is performed by moving actuating part 122*a* of solenoid 122 forwards while separation between photoreceptor drum 3 and transfer belt 103 is performed by moving actuating part 122*a* backwards. However, the actuating part may be moved in a reverse manner. That is, separation between photoreceptor drum 3 and transfer belt 103 may be performed by moving actuating part 122*a* forwards while abutment between photoreceptor drum 3 and transfer belt 103 may be performed by moving actuating part 122*a* backwards.

The Second Embodiment

Next, an image forming apparatus 1A including a transfer mechanism 100 according to the present invention will be described in detail with reference to the drawings.

Figure 7:
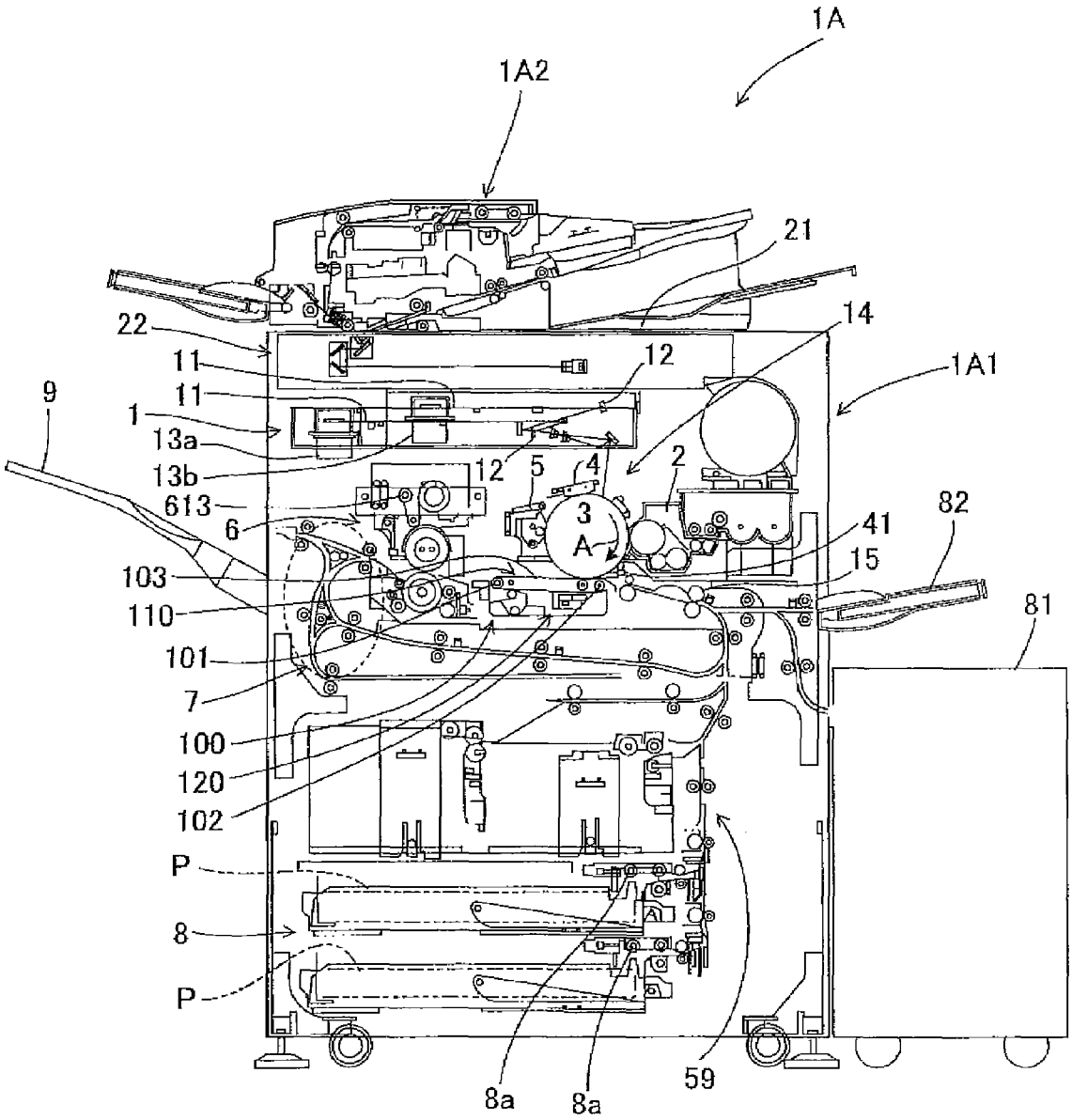
FIG. 7 is an illustrative view showing an overall configuration of an image forming apparatus that adopts a transfer mechanism in accordance with the second embodiment of the present invention.
Figure 8:
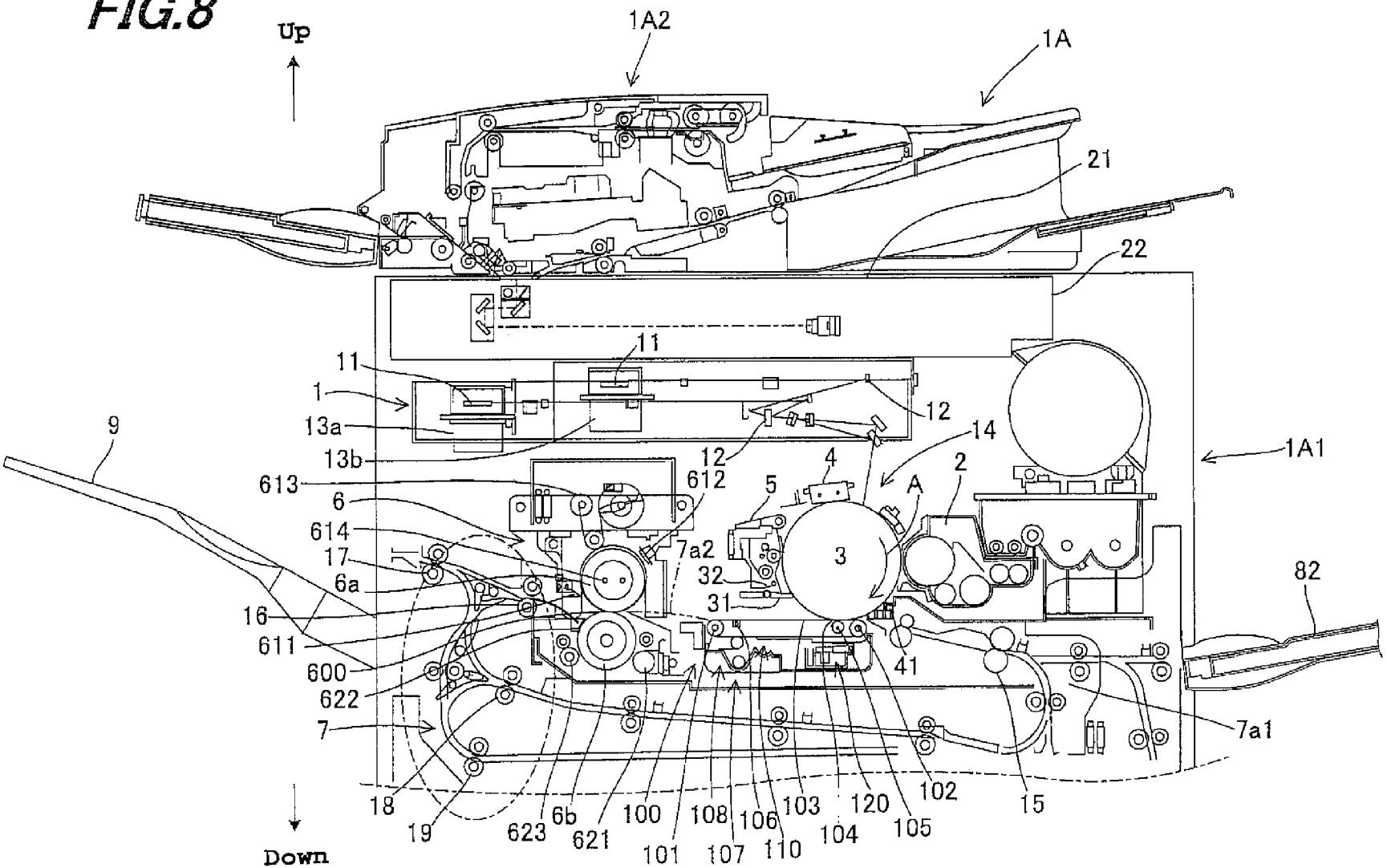
FIG. 8 is a partial detailed view showing the apparatus main body configuration of the same image forming apparatus.

FIG. 7 is an illustrative view showing the overall configuration of an image forming apparatus using a transfer mechanism according to the second embodiment of the present invention and FIG. 8 is a partial detailed view showing the configuration of the apparatus main body of the image forming apparatus.

Image forming apparatus 1A according to the present embodiment is an image forming apparatus that includes an image forming portion 14, transfer mechanism 100 and a fixing unit (fixing device) 6, and produces image output in response to a print request.

Image forming portion 14 includes a photoreceptor drum 3 on which a developer image (toner image) is formed with a developer (toner).

Transfer mechanism 100 employs the transfer mechanism of the present invention and includes the above-described transfer unit 110 and the above-described belt contact and separation assembly 120.

Fixing unit 6 fixes the toner image that was transferred on paper P to paper P.

To being with, the overall configuration of image forming apparatus 1A according to the present embodiment will be described with reference to the drawings.

As shown in FIGS. 7 and 8, image forming apparatus 1A is essentially composed of an apparatus main body 1A1 and an automatic document processor 1A2.

Apparatus main body 1A1 essentially includes a light exposure unit 1, a developing unit 2, a photoreceptor drum 3, a charger 4, a charge erasing device 41, a cleaner unit 5, a fixing unit 6, a paper feed path 7, a paper feed tray 8, a paper output tray 9, a transfer mechanism 100 and the like.

Arranged on the top surface of apparatus main body 1A1 is an original placement table 21 made of transparent glass on which a document is placed. Automatic document processor 1A2 is arranged on the top of this original placement table 21 so that it can pivotally open upwards. On the other hand, a scanner portion 22 as a document reader for reading image information of originals is laid out under this original placement table 21.

Arranged below scanner portion 22 are light exposure unit 1, developing unit 2, photoreceptor drum 3, charger 4, charge erasing device 41, cleaner unit 5, fixing unit 6, paper feed path 7, paper output tray 9 and transfer mechanism 100. Further, paper feed tray 8 for accommodating paper P is arranged under these components.

Light exposure unit 1 emits a laser beam in accordance with the image data (print image information) output from an unillustrated image processor to irradiate the photoreceptor drum 3 surface that has been uniformly charged by charger 4. In this way, light exposure unit 1 writes and forms an electrostatic latent image corresponding to the image data on the photoreceptor drum 3 surface.

Light exposure unit 1 is arranged directly under scanner portion 22 and above photoreceptor drum 3. Light exposure unit 1 includes laser scanning units (LSUs) 13*a* and 13*b* each having a laser emitter 11 and a reflection mirror 12. In the present embodiment, in order to achieve high-speed printing operation, a method for alleviating a rush of irradiation timings by using a multiple number of laser beams, namely a two-beam method, is adopted.

Here, in the present embodiment laser scanning units (LSUs) 13*a* and 13*b* are used for light exposure unit 1, but an array of light emitting elements, e.g., an EL or LED writing head may be used.

Figure 9:
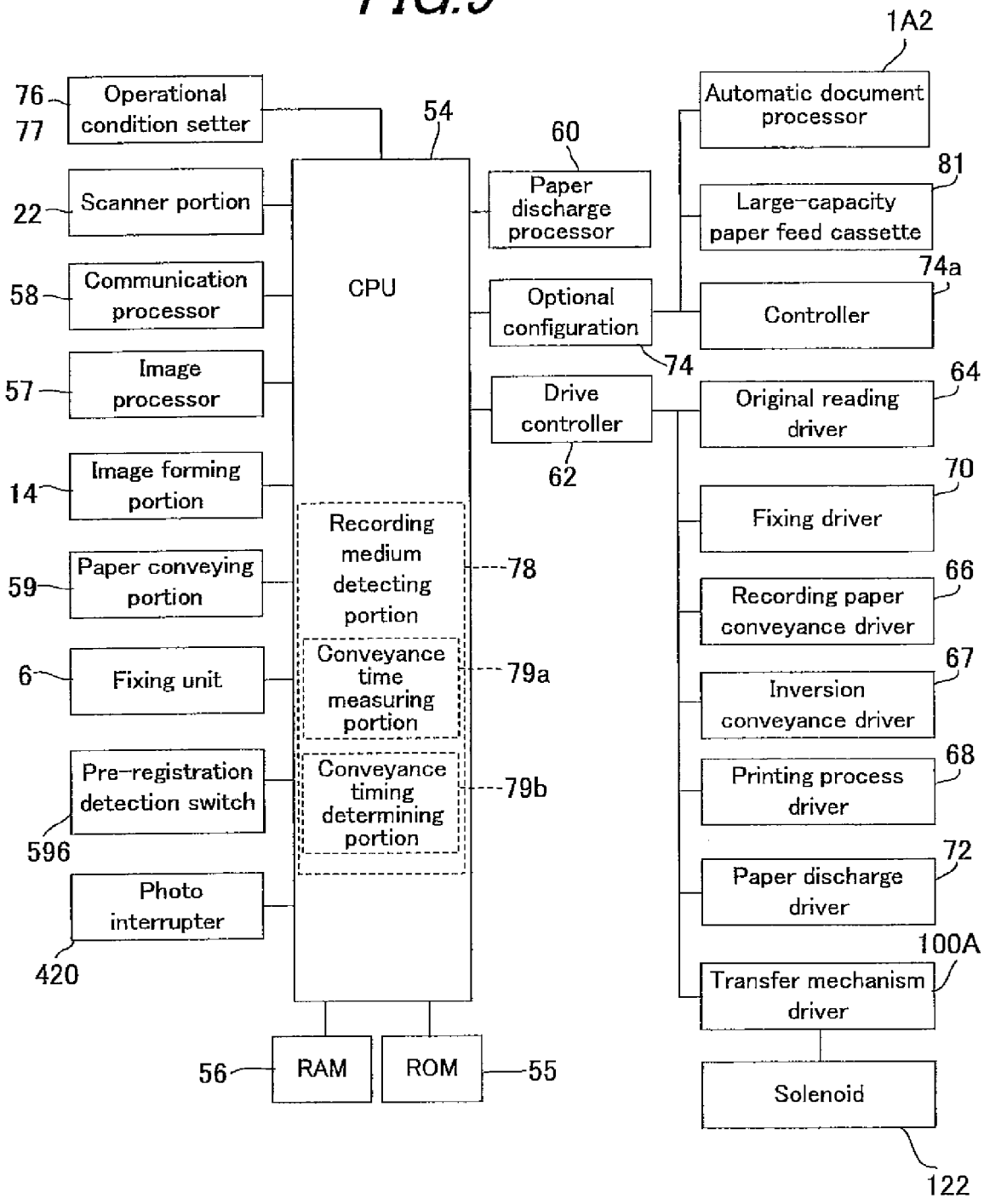
FIG. 9 is a block diagram showing an electric controller configuration of the same image forming apparatus.

Photoreceptor drum 3 has a cylindrical shape and is arranged under light exposure unit 1 as shown in FIG. 8. Photoreceptor drum 3 is controlled so as to rotate in a predetermined direction (in the direction of arrow A in the drawing) by a drive controller 62 (FIG. 9). Arranged starting from the position at which image transfer ends downstream in the rotational direction of the photoreceptor drum along the peripheral surface of this photoreceptor drum 3 are a paper separation claw 31, cleaner unit 5, charger 4 as an electric field generator, developing unit 2 and a charge erasing device 41 in the order mentioned.

Paper separation claw 31 is disposed so as to be moved into and out of contact with the outer peripheral surface of photoreceptor drum 3 by means of a solenoid 32. This paper separation claw 31, when it is put in abutment with the outer peripheral surface of photoreceptor drum 3, functions to peel off the paper P that has adhered to the photoreceptor drum 3 surface.

As a driver for paper separation claw 31, a drive motor or the like may be used instead of solenoid 32, or any other driver may also be selected.

Developing unit 2 visualizes the electrostatic latent image formed on photoreceptor drum 3 with black toner. Developing unit 2 is arranged at approximately the same level at the side (on the right side in the drawing) of photoreceptor drum 3 downstream of charger 4 with respect to the rotational direction of the photoreceptor drum (in the direction of arrow A in the drawing). A registration roller 15 is disposed under this developing unit 2.

Registration roller 15 is operated and controlled by a driver 66 (FIG. 9) and controller 62 so as to convey the paper P delivered from paper feed tray 8 (FIG. 7) into and between photoreceptor drum 3 and transfer belt 103 whilst making the leading end of the paper P register with the toner image on the photoreceptor drum 3.

Charger 4 is a charging portion for uniformly charging the photoreceptor drum 3 surface at a predetermined potential. Charger 4 is arranged over photoreceptor drum 3 and close to the outer peripheral surface thereof.

Here, a discharge type charger 4 is used in the present embodiment, but a contact roller type or a brush type may be used.

Charge erasing device 41 is a pre-transfer erasing portion for lowering the surface potential of the photoreceptor drum 3 in order to facilitate the toner image formed on the photoreceptor drum 3 surface to transfer to paper P. Charge erasing device 41 is laid out on the downstream side of developing unit 2 with respect to the photoreceptor drum's direction of rotation and under the photoreceptor drum 3 and close to the outer peripheral surface of the same.

Though in the present embodiment, charge erasing device 41 is configured using a charge erasing electrode, a charge erasing lamp or any other method for erasing charge can be used instead of the charge erasing electrode.

Cleaner unit 5 removes and collects the toner left on the surface of photoreceptor drum 3 after development and image transfer. Cleaner unit 5 is disposed at approximately the same level at the side of photoreceptor drum 3 (on the left side in the drawing), on the approximately opposite side across photoreceptor drum 3 from developing unit 2.

As described above, the visualized electrostatic image on photoreceptor drum 3 is transferred to the paper P to which transfer mechanism 100 applies an electric field having an opposite polarity to that of the electrostatic image.

For example, when the electrostatic image bears negative (−) charge, the applied polarity of transfer mechanism 100 should be positive (+).

Transfer mechanism 100 is one that was described in the first embodiment and includes transfer unit 110 and belt contact and separation assembly 120.

As shown in FIG. 8, transfer unit 110 is a transfer belt unit in which transfer belt 103 having a predetermined resistivity (ranging from $1\times10^{9}$ to $1\times10^{13}\Omega\cdot$cm in this embodiment) is wound and tensioned on a drive roller 101, a driven roller 102 and other rollers.

Transfer unit 110 is disposed under photoreceptor drum 3 with the transfer belt 103 surface put in contact with part of the outer peripheral surface of photoreceptor drum 3. This transfer belt 103 is adapted to convey paper P while pressing the paper against photoreceptor drum 3. As already mentioned in the first embodiment, transfer belt 103 is not limited to the configuration that conveys paper P, but it can be applied to a configuration that does not convey paper P.

Arranged under transfer unit 110 is belt contact and separation assembly 120.

Belt contact and separation assembly 120 has the same configuration as in the configuration of the first embodiment described above. That is, belt contact and separation assembly 120 includes lift arms 121 that abut transfer unit 110 and shift the position of transfer unit 110, a plurality of linkage members each being linked with corresponding lift arm 121 and a coil spring 123 for connecting multiple linkage members and a solenoid 122 for actuating lift arms 121 by way of linkage members.

In this belt contact and separation assembly 120, solenoid 122 is operated in accordance with a processing signal (operation signal) input to image forming apparatus 1A. When the toner image on photoreceptor drum 3 is transferred to paper P (or transfer belt 103), solenoid 122 is operated so as to bring transfer belt 103 into contact with photoreceptor drum 3. When no transfer process is done, solenoid 122 is operated in reverse so as to separate transfer belt 103 from photoreceptor drum 3.

An elastic conductive roller 105 having a conductivity different from that of drive roller 101 and driven roller 102 and capable of applying a transfer electric field is laid out at a contact point 104 where transfer belt 103 comes into contact with photoreceptor drum 3.

Elastic conductive roller 105 is composed of a soft material such as elastic rubber, foamed resin etc. This elasticity of elastic conductive roller 105 permits photoreceptor drum 3 and transfer belt 103 to come into, not line contact, but area contact of a predetermined width (called a transfer nip) with each other. This area contact makes it possible to improve the efficiency of transfer to the paper P that is being conveyed.

Further, a charge erasing roller 106 is disposed on the interior side of transfer belt 103, on the downstream side, with respect to the direction of paper conveyance, of the transfer area of transfer belt 103. Charge erasing roller 106 erases the electric field applied to the paper being conveyed through the transfer area so as to achieve smooth conveyance of paper P to the subsequent stage.

Also in transfer mechanism 100, a cleaning unit 107 and a plurality of charge erasing devices 108 are provided. Cleaning unit 107 removes dirt due to leftover toner on transfer belt 103. Charge erasing devices 108 erase electricity on transfer belt 103. Erasure of charge by erasing devices 108 may be performed by grounding the transfer belt via the apparatus or by positively applying charge of a polarity opposite to that of the transfer field to the transfer belt.

The paper P with a static image (unfixed toner) transferred thereon by transfer mechanism 100 is conveyed to fixing unit 6, where it is pressed and heated so as to fuse the unfixed toner and fix it to the paper P.

As shown in FIG. 8, fixing unit 6 includes a heat roller 6*a* and a pressing roller 6*b*. As heat roller 6*a* is rotated with paper P being held between these heat roller 6*a* and pressing roller 6*b*, paper P passes through and between heat roller 6*a* and pressing 6*b* while it is heated and pressed. In this process, the toner image transferred on paper P can be fused and fixed thereto.

Arranged on the downstream side of fixing unit 6 with respect to the direction of paper conveyance is a conveyance roller 16 for conveying paper P.

Heat roller 6*a* has a sheet separation claw 611, a roller surface temperature detector (thermistor) 612 and a roller surface cleaning member 613, arranged on the outer periphery thereof. A heat source 614 for heating the heat roller surface at a predetermined temperature (set fixing temperature: approximately 160 to 200 deg. C.) is provided inside heat roller 6*a*.

Arranged on the outer periphery of pressing roller 6*b* is a pressing member 621 which presses both ends of pressing roller 6*b* so that pressing roller 6*b* abuts heat roller 6*a* with a predetermined pressure. Also, a sheet separation claw 622 and a roller surface cleaning element 623 are provided on the outer periphery of pressing roller 6*b*, similarly to the outer periphery of heat roller 6*a*.

In this fixing unit 6, as shown in FIG. 8 the unfixed toner on the paper P being conveyed is heated and fused by heat roller 6*a*, at the pressed contact (so-called fixing nip portion) 600 between heat roller 6*a* and pressing roller 6*b*, so that the unfixed toner is fixed to the paper P by its anchoring effect to the paper P by the pressing force from heat roller 6*a* and pressing roller 6*b*.

Paper feed tray 8 (FIG. 7) can accommodate a stack of sheets (paper) to which image information will be output (printed). Paper feed tray 8 is arranged under image forming portion 14 made up of light exposure unit 1, developing unit 2, photoreceptor drum 3, charger 4, charge erasing device 41, cleaner unit 5, fixing unit 6 etc. A paper pickup roller 8*a* is disposed at an upper position on the paper delivery side of this paper feed tray 8.

This paper pickup roller 8*a* (FIG. 7) picks up paper P, sheet by sheet, from the topmost of a stack of paper stored in paper feed tray 8, and conveys the paper downstream (for convenience' sake, the delivery side of paper P (the cassette side) is referred to as upstream and the direction of conveyance is referred to as downstream). That is, paper pickup roller 8*a* conveys paper P to the registration roller (also called "idle roller") 15 side in paper feed path 7.

Since the image forming apparatus 1A according to the present embodiment is aimed at performing high-speed printing operations, a multiple number of paper feed trays 8 each capable of stacking 500 to 1500 sheets of standard-sized paper P are arranged under image forming portion 14. Further, a large-capacity paper feed cassette 81 capable of storing multiple kinds of paper in large volumes is arranged at the side of apparatus 1A. Also, a manual feed tray 82 for mainly supporting printing etc. for irregular sized paper is arranged over the large-capacity paper feed cassette 81.

Paper output tray 9 is arranged on the opposite side across the apparatus from that of manual feed tray 82. Also, apparatus 1A may include, instead of paper output tray 9, a postprocessing machine for output paper (machine for stapling, punching and other tasks) and/or a multi-bin paper output tray etc., as an option.

Paper feed path 7 is laid out between the aforementioned photoreceptor drum 3 and paper feed tray 8, and conveys paper P supplied from paper feed tray 8, sheet by sheet, to transfer mechanism 100. In transfer mechanism 100 a toner image is transferred from photoreceptor drum 3 to the paper, which is conveyed to fixing unit 6. The paper with an unfixed toner image fixed thereon in fixing unit 6 is then conveyed by an inversion conveyance roller 18 and a switch back roller 19, along the paper feed paths and branch guides, set for the designated processing mode.

Next, the control system of image forming apparatus 1A according to the present embodiment will be described in detail with reference to the drawings.

FIG. 9 is a block diagram showing an electric controller configuration of the image forming apparatus according to the present embodiment.

As shown in FIG. 9, the image forming apparatus 1A according to the present embodiment performs processes such as image reading, image processing, image forming and conveyance of paper P, etc., by a central processing unit (CPU) 54 in accordance with the program stored beforehand in a ROM (read only memory) 55, using temporal storage such as a RAM (random access memory) 56 etc.

Here, it is also possible to use other storage means such as a HDD (hard disk drive) etc., instead of ROM 55 and RAM 56.

In image forming apparatus 1A, the image information of an original (original image data) captured by scanner portion 22, or original image information transmitted from other terminal devices connected on an unillustrated communication network, is adapted to be input to an image processor 57 by way of a communication processor 58.

Image processor 57 shapes the original image information stored in the storage such as RAM 56 or the like into printing image information that is suitable for printing (image forming onto paper), in accordance with the aforementioned program.

The printing image information is input to image forming portion 14.

Image forming portion 14, a paper conveying portion (performing various detentions and controls of the paper in paper feed path 7 etc.) 59, fixing unit 6 and paper discharge processor (performing various detections and controls of the paper in paper discharge path 17) 60 are linked with respective components of drive controller 62.

The paper conveyed by paper conveying portion 59 advances through the printing stage (the printing process of image information in image forming portion 14) and then a fixing stage (fixing unit 6) for the printed paper P and is discharged to the paper discharge portion (paper output tray 9).

Here, paper conveying portion 59 is adapted to receive detection signals from a pre-registration detection switch 596, an unillustrated fixing detection switch and paper discharge detecting switch etc.

Pre-registration detection switch 596 is a switch that detects whether the paper reaches registration roller 15. The fixing detection switch is a switch that detects whether the paper reaches fixing unit 6. The paper discharge detecting switch is a switch that detects whether the paper has been discharged.

Image forming apparatus 1A further has an operational condition setter 77.

This operational condition setter 77 sets up operational conditions for image forming and conditions of conveyance etc., in image forming apparatus 1A, in accordance with the image forming request or the image forming conditions such as the type of recording media (paper) etc., designated by the user through control switches 76.

Further, in image forming apparatus 1A, based on the set operating conditions, an original reading driver 64, a paper conveyance driver 66, an inversion conveyance driver 67, a printing process driver 68, a transfer mechanism driver 100A, a fixing driver 70, a paper discharge driver 72 and large-volume paper feed cassette (paper feed unit) 81 are operated following the instructions from CPU 54 in accordance with the program stored in ROM 55 so that these drivers can operate in synchronization.

Original reading driver 64 is a drive actuator for the reading portion (scan portion 22).

Paper conveyance driver 66 is a drive actuator for paper conveying portion 59, specifically, drive motors for paper pickup roller 8*a* and registration roller 15 arranged along the aforementioned paper feed path 7.

Inversion conveyance driver 67 includes drive motors for inversion conveyance roller 18 and switch back roller 19.

Printing process driver 68 is a drive actuator for image forming portion 14 and the like, and its example is a drive motor for photoreceptor drum 3.

Transfer mechanism driver 100A is a drive actuator for transfer mechanism 100 etc.

Fixing driver 70 is of drive motors for heat roller 6*a* and pressing roller 6*b* in fixing unit 6.

Paper discharge driver 72 is a drive actuator for paper discharge processor 60 etc., including drive motors for paper discharge roller 17, etc.

The drive sources of the drive motors for all these drivers may be provided as common or different drive motors with appropriate power transmission mechanisms.

Transfer mechanism driver 101A includes solenoid 122 for moving transfer unit 110 into and out of contact with photoreceptor drum 3. Transfer mechanism driver 101A performs its operation in synchronism with the operation of drive roller 101 of transfer belt 103 and the operations of paper conveyance driver 66, printing process driver 68, etc.

Further, image forming apparatus 1A may be used with optional configurations 74 including post-processors (stapler, puncher, multi-bin paper output trays, shifter, etc.), automatic document reader (automatic document processor 1A2 etc.), large-volume paper feed cassette 81 and the like. These optional configurations 74 incorporate individual controllers 74*a* separately from the controller of image forming apparatus 1A so that each processor can operate in synchronization with the main apparatus by performing timing adjustment via the aforementioned communication processor 58.

A recording medium detecting portion 78 detects arrival of the leading end of the paper at fixing unit 6 or the output portion. Specifically, recording medium detecting portion 78 includes: a conveyance time measuring portion 79*a* and a conveyance timing determining portion 79*b*.

Conveyance time measuring portion 79*a* measures the time for conveyance of the paper from when the paper is delivered from registration roller 15 at the entrance of paper feed path 7 where the paper is introduced.

Conveyance timing determining portion 79*b* determines the timings at which the paper is conveyed in paper feed path 7, based on the distances from registration roller 15 to fixing unit 6 and discharge roller 17 to be controlled, and the paper's speed of conveyance.

In this embodiment recording medium detecting portion 78 is adapted to detect the timings at which the paper arrives at (enter) fixing unit 6 and paper discharge roller 17 based on the conveyance timing of recording medium detected by conveyance timing determining portion 79*b*.

According to the present embodiment as described heretofore, use of transfer mechanism 100 according to the present invention for image forming apparatus 1A assures a reliable operation of contact and separation between photoreceptor drum 3 and transfer belt 103, hence making it possible to achieve stable transfer and paper conveyance. Thus, this configuration contributes to realization of high quality image output.

Further, according to the present embodiment, it is possible to reliably achieve the operation of contact and separation between photoreceptor drum 3 and transfer belt 103 at suitable timing without keeping transfer belt 103 in continuous contact with photoreceptor drum 3. As a result, it is possible to prevent photoreceptor drum 3 and transfer belt 103 from being worn out, hence making it possible to lengthen the lives of these components.

It should be noted that the present invention is not limited to the image forming apparatus illustrated in the above embodiment, and the present invention can be developed into image forming apparatus having different configurations from the present embodiment as long as it includes an equivalent transfer mechanism or a configuration akin to that.

What is claimed is:

1. A transfer mechanism comprising:

a transfer unit having a transfer belt; and, a belt contact and separation assembly for bringing the transfer belt into, and separating it away from, an electrostatic latent image support by shifting the position of the transfer unit, characterized in that the belt contact and separation assembly includes:

a plurality of transfer unit shifters that abut the transfer unit and shift the position of the transfer unit;

a plurality of linkage members that link with the plural transfer unit shifters, correspondingly;

an elastic member for coupling the plural linkage members; and a driver for actuating the transfer unit shifters through the linkage members.

2. The transfer mechanism according to claim 1, wherein the driver is a solenoid.

3. The transfer mechanism according to claim 1, wherein the transfer unit shifter makes rotational movement as the driver operates.

4. The transfer mechanism according to claim 1, wherein the driving force of the driver is directly transmitted to a first one of the plural transfer unit shifters, and the driving force is indirectly transmitted to the transfer unit shifters other than the first transfer unit shifter, by way of the elastic member.

5. The transfer mechanism according to claim 1, wherein the transfer unit shifters are actuated by the driving force of the driver to shift the transfer unit up and down, so as to bring the transfer unit into contact with and separate it away from, the electrostatic latent image support.

6. The transfer mechanism according to claim 1, wherein the transfer unit shifters are arranged at both side ends of the width of the transfer belt of the transfer unit.

7. The transfer mechanism according to claim 1, wherein, when the transfer belt is set at the home position for separation in which the transfer belt is kept away from the electrostatic latent image support, the first transfer unit shifter arranged close to the driver is positioned a first distance away from the electrostatic latent image support;

the second transfer unit shifter arranged farther from the driver than the first transfer unit shifter is positioned a second distance away from the electrostatic latent image support; and, the second distance is shorter than the first distance.

8. The transfer mechanism according to claim 7, wherein, at the home position for separation, the transfer belt is separated from the electrostatic latent image support, keeping a uniform gap distance across the full length of the transfer belt.

9. The transfer mechanism according to claim 8, further comprising a holding member for holding the transfer unit in order to assure the uniform gap distance.

10. The transfer mechanism according to claim 8, wherein the uniform gap distance is at least a distance that prohibits the residual toner on the electrostatic latent image support from transferring to the transfer belt under the influence of the electric field applied to the transfer belt.

11. An image forming apparatus for producing image output in accordance with a print request, comprising:

an image forming portion having an electrostatic latent image support on which a developer image is formed with a developer;

a transfer mechanism for transferring the developer image to the transfer belt side; and, a fixing unit for fixing the developer image transferred by the transfer mechanism, onto the recording medium, characterized in that the transfer mechanism comprises:

a transfer unit having a transfer belt; and, a belt contact and separation assembly for bringing the transfer belt into, and separating it away from, an electrostatic latent image support by shifting the position of the transfer unit, and the belt contact and separation assembly includes:

a plurality of transfer unit shifters that abut the transfer unit and shift the position of the transfer unit;

a plurality of linkage members that link with the plural transfer unit shifters, correspondingly;

an elastic member for coupling the plural linkage members; and a driver for actuating the transfer unit shifters through the linkage members.

12. The image forming apparatus according to claim 11, wherein the driver is a solenoid.

13. The image forming apparatus according to claim 11, wherein the transfer unit shifter makes rotational movement as the driver operates.

14. The image forming apparatus according to claim 11, wherein the driving force of the driver is directly transmitted to a first one of the plural transfer unit shifters, and the driving force is indirectly transmitted to the transfer unit shifters other than the first transfer unit shifter, by way of the elastic member.

15. The image forming apparatus according to claim 11, wherein the transfer unit shifters are actuated by the driving force of the driver to shift the transfer unit up and down, so as to bring the transfer unit into contact with and separate it away from, the electrostatic latent image support.

16. The image forming apparatus according to claim 11, wherein the transfer unit shifters are arranged at both side ends of the width of the transfer belt of the transfer unit.

17. The image forming apparatus according to claim 11, wherein, when the transfer belt is set at the home position for separation in which the transfer belt is kept away from the electrostatic latent image support, the first transfer unit shifter arranged close to the driver is positioned a first distance away from the electrostatic latent image support;

the second transfer unit shifter arranged farther from the driver than the first transfer unit shifter is positioned a second distance away from the electrostatic latent image support; and, the second distance is shorter than the first distance.

18. The image forming apparatus according to claim 17, wherein, at the home position for separation, the transfer belt is separated from the electrostatic latent image support, keeping a uniform gap distance across the full length of the transfer belt.

19. The image forming apparatus according to claim 18, wherein the transfer mechanism further comprises a holding member for holding the transfer unit in order to assure the uniform gap distance.

20. The image forming apparatus according to claim 18, wherein the uniform gap distance is at least a distance that prohibits the residual toner on the electrostatic latent image support from transferring to the transfer belt under the influence of the electric field applied to the transfer belt.

* * * * *